US005441475A

United States Patent [19]

Storruste et al.

[11] Patent Number: 5,441,475

[45] Date of Patent: Aug. 15, 1995

[54] CENTRIFUGAL SEPARATOR WITH AXIALLY SEPARABLE BOWL ELEMENTS

[75] Inventors: Steinar Storruste, Salina; Mark A. Preisser, Haven, both of Kans.

[73] Assignee: Haahjem North America, Inc., Salina, Kans.

[21] Appl. No.: 264,774

[22] Filed: Jun. 23, 1994

[51] Int. Cl.[6] ..... B04B 1/14

[52] U.S. Cl. ..... 494/48; 494/67

[58] Field of Search ..... 494/2, 4, 43, 47, 48, 494/56, 60, 62, 67, 84, 901; 210/369, 370, 377, 380.1

[56] References Cited

U.S. PATENT DOCUMENTS

| | | | |
|---|---|---|---|
| 571,912 | 11/1896 | Abell | 210/370 |
| 622,712 | 4/1899 | Rissmuller | 494/48 |
| 686,917 | 11/1901 | Baker | 210/370 |
| 1,585,393 | 5/1926 | Laughlin | 494/48 X |
| 1,640,707 | 8/1927 | Laughlin | 494/67 X |
| 1,947,844 | 2/1934 | Gish | 494/48 |
| 2,233,855 | 3/1941 | Suss | 494/48 X |
| 2,312,829 | 3/1943 | Bird et al. | |
| 2,510,781 | 6/1950 | Howard | 494/62 |
| 4,347,971 | 9/1982 | Novoselac | 494/48 X |
| 4,366,951 | 1/1983 | Belsky et al. | 210/370 X |
| 4,846,781 | 7/1989 | Knelson | |
| 4,983,156 | 1/1991 | Knelson | |
| 5,037,373 | 8/1991 | Mozley | |
| 5,156,586 | 10/1992 | Fitch, Jr. et al. | 494/67 |
| 5,156,751 | 10/1992 | Miller | |

FOREIGN PATENT DOCUMENTS

| | | |
|---|---|---|
| 239405 | 10/1911 | Germany |
| 95639 | 5/1960 | Norway |
| 802000 | 9/1958 | United Kingdom |
| 2117276 | 10/1983 | United Kingdom |

*Primary Examiner*—Charles E. Cooley
*Attorney, Agent, or Firm*—Richard C. Litman

[57] ABSTRACT

A centrifugal separator has a separation chamber housing split into mating, unhinged clamshell sections. One clamshell section includes a pipe extending through the other clamshell section. The separation chamber rotates about the axis of the pipe. A spring secured to the frame of the separator surrounds the pipe, bearing against the second aforementioned clamshell section. This spring yieldingly opposes separation. The pipe and axis of rotation are oriented vertically. The pipe is divided into an upper inlet section and a lower outlet section by a flange or baffle. In alternative embodiments, the inlet pipe is fixed to different components, namely, one clamshell section, the other clamshell section, or to the frame of the machine. A slurry is introduced into the pipe inlet section, falls due to gravity, strikes the baffle, and exits the pipe through holes formed in the wall. The baffle redirects incoming slurry radially, so that when the separator is operated, centrifugal forces immediately act thereon. The denser component of the slurry is slung outwardly, eventually wedging the two clamshell sections apart, and thus forming a gap. This denser component is ejected through the gap into a shroud. The other component of the slurry is forced radially inwardly, and can escape only through the outlet. The outlet is substantially a mirror image of the inlet, having holes enabling the second component to enter the outlet. The second material then falls downwardly due to gravity, and is discharged through the outlet portion of the pipe.

3 Claims, 4 Drawing Sheets

CENTRIFUGAL SEPARATOR WITH AXIALLY SEPARABLE BOWL ELEMENTS

BACKGROUND OF THE INVENTION

1. FIELD OF THE INVENTION

The present invention relates to an apparatus including a rotating chamber for separating a denser material from a less dense material. Either a solid is removed from a slurry or a liquid is separated from a mixture of liquids of different densities.

2. DESCRIPTION OF THE PRIOR ART

Centrifugal separation of respective solid and liquid constituents is well known in the prior art. In a first type of separator, the solids are trapped in a rotating drum, and the liquid fraction permeates therethrough, escaping to the outside of the drum. The drum is generally perforated to accomplish the selective entrapping of solids. This approach is seen in U.S. Pat. No. 2,312,829, issued to Byron M. Bird et al. on Mar. 2, 1943.

Some centrifugal separators cause the solid to migrate along the walls of the drum in response to centrifugal force. U.S. Pat. No. 4,846,781, issued to Benjamin V. Knelson on Jul. 11, 1989; U.S. Pat. No. 4,983,156, issued to Benjamin Knelson on Jan. 8, 1991; and U.S. Pat. No. 5,156,751, issued to Neal J. Miller on Oct. 20, 1992, are exemplary. Solids are trapped in grooves formed in the drum for this purpose in the inventions of Knelson. Solids are discharged centrifugally in Miller's device.

The above cited prior art references share the characteristic wherein the chamber defined by the rotating drum is of fixed dimensions. Variable dimension chambers are also possible. Norwegian Pat. No. 95,639, dated May, 1960, and German Pat. No. 239,405, dated October, 1911 both disclose chambers which expand axially under the influence of centrifugal force. This expansion is resisted by a spring in the Norwegian reference.

The German device is directed more towards dispensing sugar in an even stream than in accomplishing separation.

The Norwegian invention is explicitly intended for separation, and provides two mating bowls which define a centrifugal separating chamber therebetween. These bowls spread apart radially under centrifugal action, and solids are discharged through the variable width gap established between the bowls.

Although there are certain shared features between the Norwegian invention and the present invention, there are also significant differences. The Norwegian invention lacks a baffle provided in the present invention, and has perforated bowls for enabling escape of liquids. Resultant circuits of liquids through the two devices is markedly different. Also, the Norwegian separator is potentially susceptible to blockage by particles larger than the perforations in the bowl walls. By contrast, in the present invention, there is only one escape orifice for solids. This orifice is larger than the perforations found in the Norwegian device. Also, this orifice becomes progressively larger with increasing rotational speed.

None of the above inventions and patents, taken either singly or in combination, is seen to describe the instant invention as claimed.

SUMMARY OF THE INVENTION

The present invention enables continuous separation of a solid from a liquid, and even a liquid from another liquid. A slurry is fed into the device from the top through an inlet conduit, and falls until it strikes a horizontal baffle. This baffle obstructs further downward fall, and causes the slurry to flow radially outwardly. The slurry is then immediately subjected to centrifugal forces.

The separation chamber is defined by two frustoconical bowls which contact one another under static conditions, thus sealing the chamber. Once the device reaches operational speed, a progressively increasing quantity of solid or liquid material presses against the bowls, and wedges them apart. This separation is yieldingly opposed by a spring. Most of the material escapes through the gap existing between the bowls, and is ejected from the separation chamber. The material is then caught and collected by a shroud surrounding the separation chamber. Then, due to the action of the spring, the bowls close, in the absence of sufficient material to wedge them apart. In other words, some material remains along the mating rims of the bowls.

The materials separates from one another at operational speeds because the denser material packs tightly against the joint between the bowls. The lighter liquid is displaced radially, towards the axis of rotation. A discharge conduit enables the liquid to fall downwardly from the separation chamber.

The same principle operates in separating two liquids of different densities. The heavier liquid will be forced out at the joint, and the lighter liquid will be discharged at the centrally located conduit. This principle may be applied to, for example, an oil and water emulsion, among other liquid emulsions and combinations.

The inlet and outlet conduits are formed from a pipe or the like. This pipe is divided into inlet and outlet conduits by the baffle. This baffle totally obstructs the pipe, separating the inlet portion from the outlet portion.

The pipe, baffle, and lower bowl form a unitary member. This member is supported on suitable bearings. The upper bowl is urged downwardly against the lower bowl by a spring. At a predetermined, operational rotational speed, centrifugal force is great enough to overcome the spring, and the bowls spread apart. In various embodiments, this spring can be a coil spring, or may operate by hydraulic or pneumatic pressure.

The upper and lower bowls are rotated by a drive including a motor, a belt, and appropriate sheaves. One sheave is mounted to the pipe.

An important feature of the novel arrangement is that there are no perforations formed in the centrifuge. There is a variable opening or gap formed between the mating bowls, which is fairly clog resistant.

Preferably, the axis of rotation is vertical, although the axis could be tilted, or even horizontal.

Operation characteristics are controlled by selecting spring resistance, by operating the device at a suitable speed for the material being separated, by consideration of the relative densities of the material being processed, and by the radii and depth of the respective bowls.

Of course, materials other than sand or gravel slurries can be separated by the novel separator, water and oil, for example. As long as one of the materials is of a lesser density than that of the other materials, the centrifugal separator will be successful in separating the materials into constituent fractions.

Accordingly, it is a principal object of the invention to provide apparatus for separating two materials by centrifugal action.

It is another object of the invention to bring centrifugal forces to bear on incoming slurry as expeditiously as possible.

It is a further object of the invention selectively to vary separation of the halves or sections of the separation chamber.

An additional object of the invention is to construct the centrifugal separator by employing a pipe to form an inlet and outlet for the separation chamber. It is again an object of the invention to include a power source and an appropriate drive for rotating the bowls.

Still another object of the invention is to impose a yielding force yieldingly clamping the upper and lower bowls together.

Yet another object of the invention is to separate any slurry containing a relatively dense material and a relatively light and fluent material.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
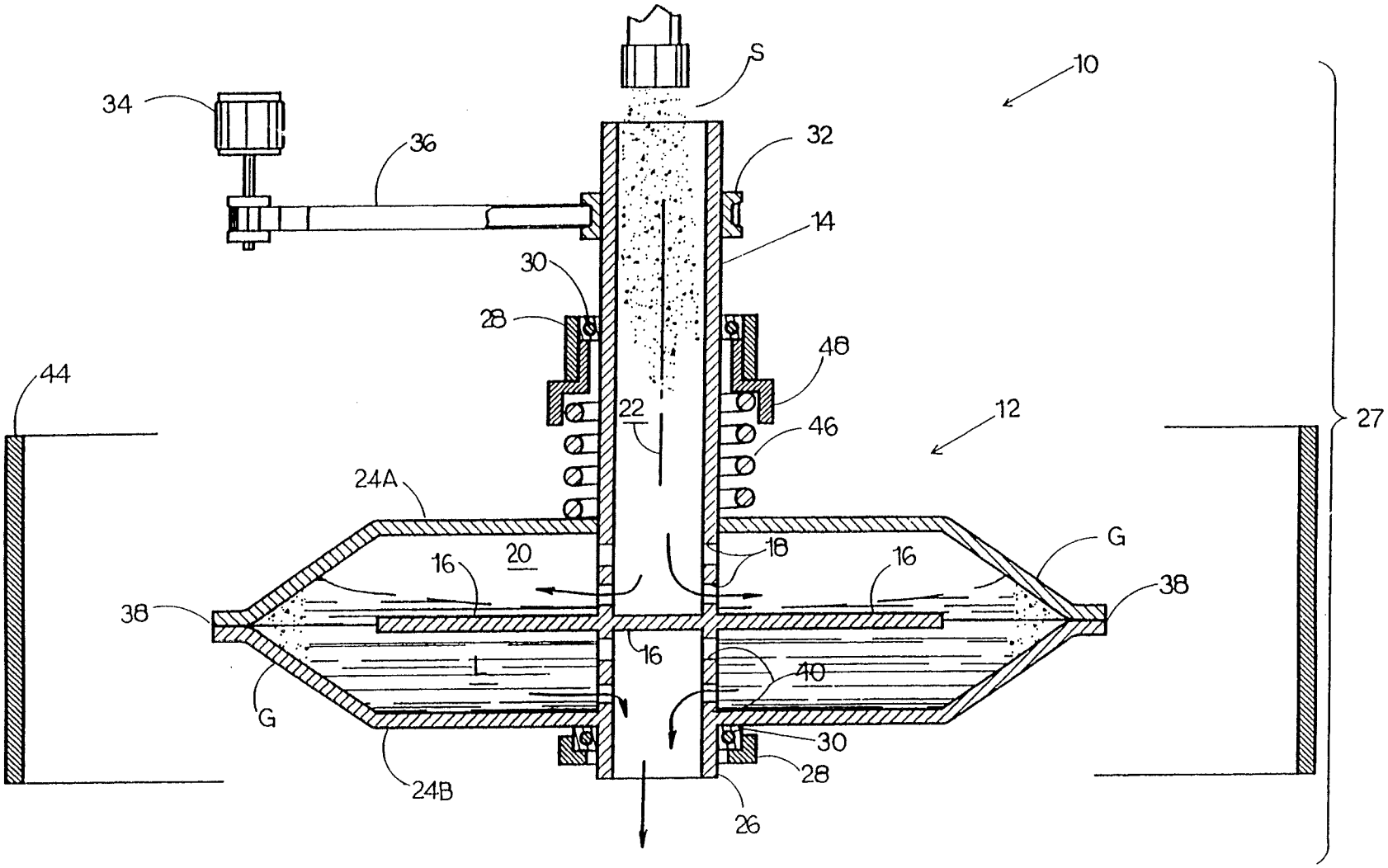
FIG. 1 is a diagrammatic, environmental, side cross-sectional view of the invention before the bowls separate.

FIG. 1 illustrates operation of the novel centrifugal separator 10 at low speeds. Under these conditions, a slurry S comprising mixed materials having relatively greater and lesser densities, and combining to form a fluent mixture, enters a housing 12 through inlet pipe 14. Slurry S falls under the influence of gravity through inlet pipe 14, until it encounters a baffle 16. Baffle 16 entirely obstructs inlet pipe 14. Slurry S is redirected to flow through holes 18 formed in inlet pipe 14, and is slung radially outwardly by baffle 16 into housing 12.

Housing 12 encloses a separation chamber 20 defined between two frustoconical bowls 24A,24B which are arranged in mirror image relation to one another. Inlet pipe 14 is integral to outlet pipe 26, and also to baffle 16 and lower bowl 24B. Bowls 24A,24B and inlet and outlet pipes 14,26 are supported on a stationary frame 27, as by suitable bearings 30. Bowls 24A,24B, inlet and outlet pipes 14,26, and baffle 16 generally rotate about an axis 22 as an integral unit. Upper bowl 24A is axially movable about axis 22, being able to lift upwardly, as seen in the depiction of FIG. 1.

Inlet pipe 14 conveniently serves the purposes of directing incoming slurry S to flow into separation chamber 20, defines axis 22, and provides a guide constraining bowl 24A to move axially along axis 22 when separating from bowl 24B.

Rotation is imparted to inlet pipe 14 at sheave 32 fixed thereto. Sheave 32 is driven from a motor 34 supported by frame 27, as by belt 36.

The flow of slurry S and a liquid L which is separated therefrom is indicated by arrows. After entering separation chamber 20, slurry S is separated by centrifugal action. Relatively dense solids G are slung against a joint 38 existing at the abutment of bowls 24A and 24B. Liquid L is displaced, and is forced radially back towards outlet pipe 26. Liquid L enters outlet pipe 26 through holes 40, falling downwardly to a suitable collector (not shown).

Figure 2:
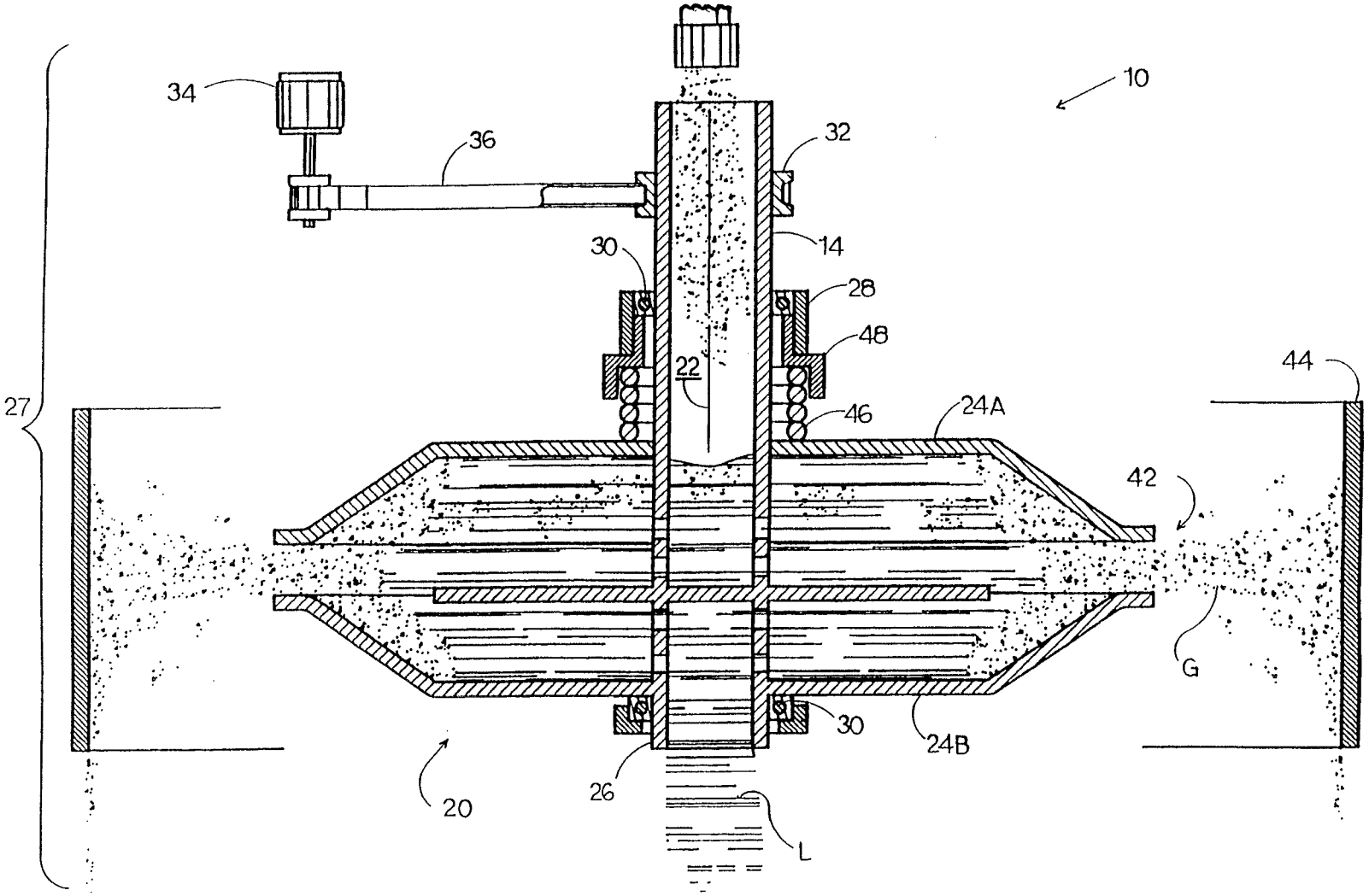
FIG. 2 corresponds to FIG. 1, but shows the bowls separating under the influence of centrifugal force.

Solids G will build up at joint 38 until rotational speed is such that bowls 24A and 24B separate. This is shown in FIG. 2. At sufficiently high rotational speeds, bowls 24A and 24B separate, and joint 38 (see FIG. 1) widens into a gap 42. Solids G are ejected through gap 42, and are intercepted by a shroud 44 disposed about separation chamber 20. Solids G then drop into a suitable hopper (not shown) for subsequent disposal.

A compression spring 46 is shown in an extended condition in FIG. 1. Spring 46 is retained in place surrounding inlet pipe 14 by upper bowl 24A and a spring keeper 48 affixed to spring frame 28. Turning again to FIG. 2, spring 46 yieldingly clamps the upper and lower bowls together such that rotary motion from the sheave 32 is imparted to the driven lower bowl 24B and thus to the upper bowl 24A which is clamped to the lower bowl 24B. The spring 46 opposes separation of the clamped bowls 24A and 24B until centrifugal force overcomes the resistance of spring 46. Upper bowl 24A moves upwardly, and solids G are ejected through gap 42. Liquid L is discharged through outlet pipe 26.

Although a coil spring is illustrated, it will be appreciated that still other forms of springs will serve in equal capacity. For example, a pneumatic spring, a hydraulically pressured spring, and magnetic forces may all be employed to bring a yielding resistive force to bear upon bowl 24A.

Figure 3:
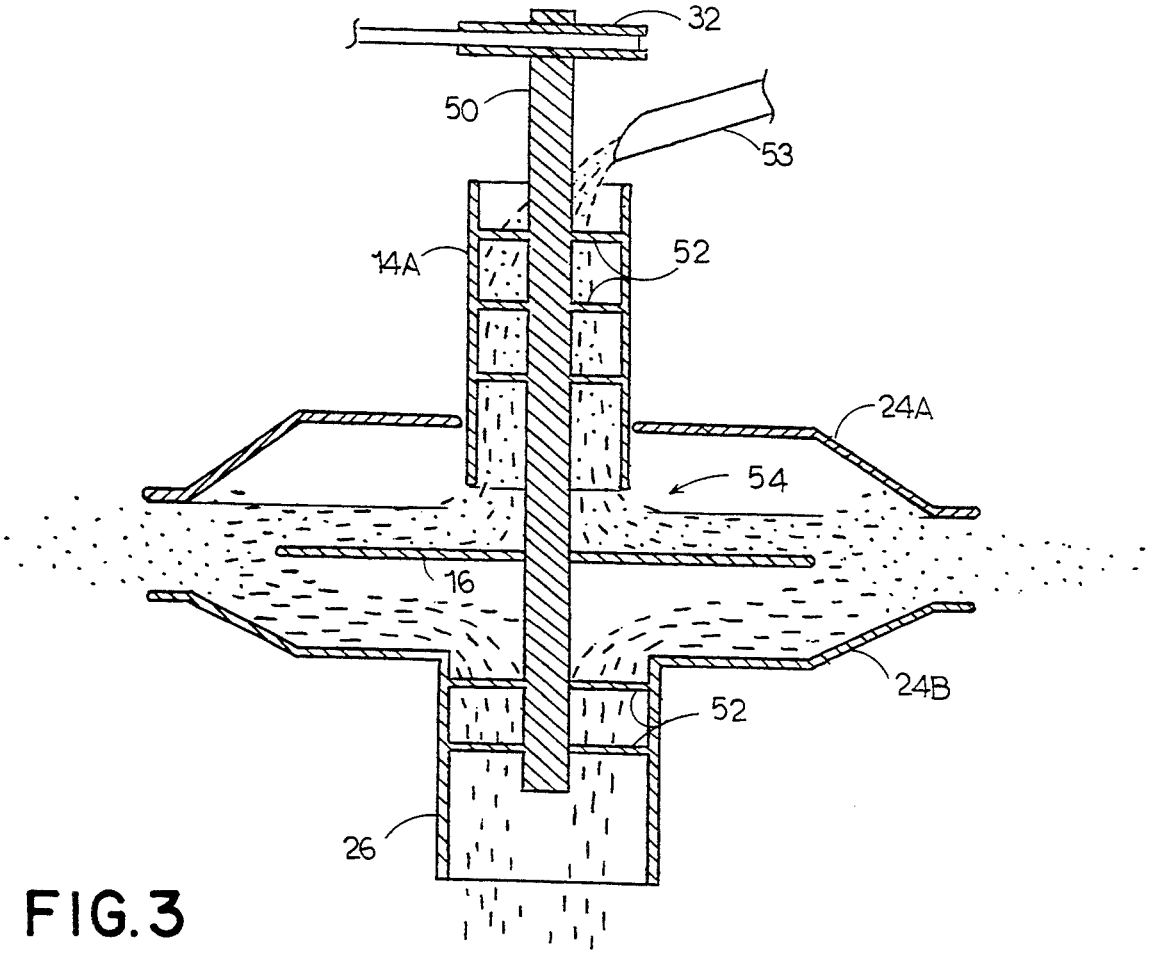
FIG. 3 is a diagrammatic, primarily cross-sectional view of an alternative embodiment of the invention.
Figure 5:
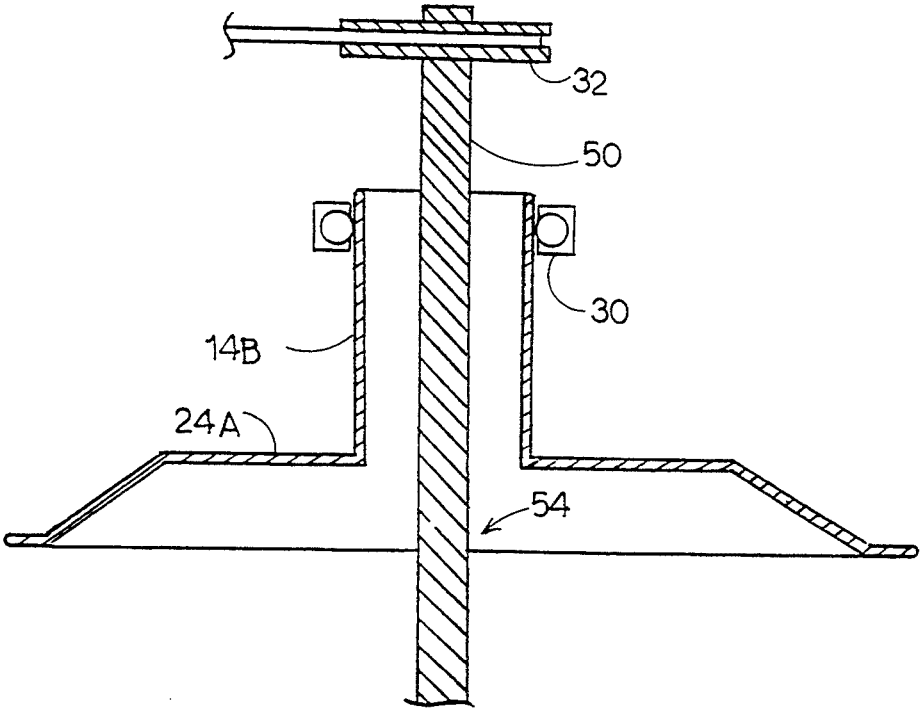
FIGS. 5 and 6 are cross-sectional detail views of two further alternative embodiments of the invention.
Figure 6:
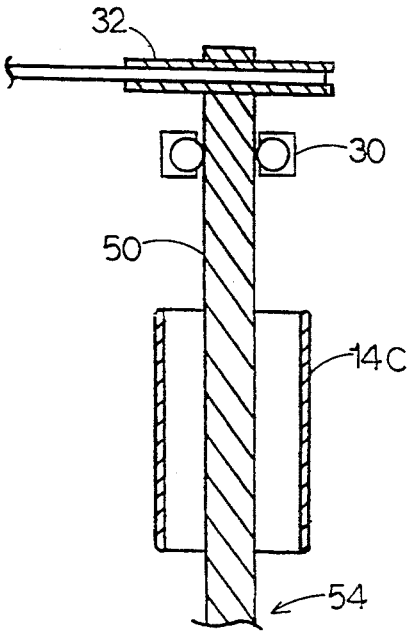

Several arrangements of the inlet pipe are seen in embodiments illustrated in FIGS. 3, 5, and 6. Turning first to FIG. 3, inlet pipe 14A has a central rod 50 for transmitting rotary motion from the drive, the latter represented illustratively by sheave 32 to the lower bowl 24B. Inlet pipe 14A terminates well above baffle 16. Inlet pipe 14A, rod 50, links 52, baffle 16, lower bowl 24B, and outlet pipe 26 all form a unitary member supported on bearings 30 (see FIG. 1). Upper bowl 24A moves axially with respect to rod 50 and inlet pipe 14A.

A chute 53 discharges material to be separated into the opening at the top of inlet pipe 14A.

Figure 4:
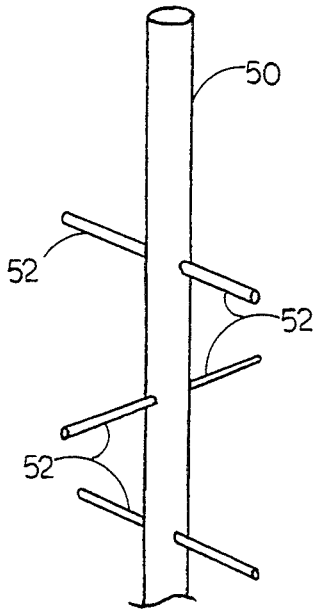
FIG. 4 is a perspective detail view of a component of the embodiment of FIG. 3.

FIG. 4 clearly shows the arrangement of links 52. Links 52 are staggered axially along rod 50, and are also staggered around the circumference of rod 50. As illustrated in this Figure, links 52 are offset by ninety degrees. This feature helps prevent clogging if larger solids are present. Also, the effective cross sectional area of inlet pipe 14A is maintained as much as is feasible.

This construction avoids holes 18 seen in FIG. 1, providing thereinstead a substantial gap 54 as shown in FIG. 3. Less wear will occur to inlet pipe 14A when separating abrasive slurries, for example. Also, gap 54 has more unobstructed area than several holes 18, so that greater flow is accommodated.

The same construction wherein gap 54 is defined below inlet pipe 14A is seen in the embodiments shown in FIGS. 5 and 6. In FIG. 5, inlet pipe 14B is formed integrally with upper bowl 24A. The manner of introducing material for separation is the same as in the embodiment of FIG. 3. Additional bearings 30 are provided where necessary. Rod 50 transmits rotary motion from the drive to the lower bowl.

FIG. 6 shows still another embodiment wherein an inlet pipe 14C is separate from both bowls 24A and 24B. Instead, inlet pipe 14C is fixed, as to frame 27 (see FIG. 1). Rod 50 transmits rotary motion from the drive to the lower bowl.

In the embodiments of FIGS. 3–6, only those components modified to provide the new embodiment or varying from the embodiment of FIG. 1 are shown. The other components are understood to be present, substantially as presented in the embodiment of FIG. 1. For example, elements such as the spring 46 and spring keeper 48 are present in the embodiments of FIGS. 3–6 to impose a yielding force yieldingly clamping the upper and lower bowls together such that the rotary motion imparted to the lower bowl 24B by the drive (sheave 32) and rod 50 is transmitted to the upper bowl for rotation of the upper and lower bowls about axis 22.

In still another embodiment, the rotational axis of bowls 24A and 24B, may be other than vertical, extending even to the horizontal.

It is to be understood that the present invention is not limited to the embodiments described above, but encompasses any and all embodiments within the scope of the following claims.

We claim:

1. A centrifugal separator for separating mixed materials having relatively greater and lesser densities from a fluent mixture thereof comprising:

a stationary frame;

a housing supported by said stationary frame, said housing further comprising:

a separable upper member rotatably movable about a vertical axis and an axially stationary lower member defining an enclosed centrifugal separation chamber therebetween, there being a gap defined between said upper member and said stationary lower member when separated;

an inlet pipe penetrating said upper member and being coaxial with said vertical axis and defining an inlet into said separation chamber for admitting the fluent mixture thereinto for subsequent separation, said fluent mixture containing a material of lesser relative density and a material of greater relative density, said inlet constraining the fluent mixture to flow into said chamber in a predetermined direction parallel to said vertical axis;

an outlet pipe attached to said stationary lower member and being coaxial with said vertical axis and defining an outlet for discharging said material of lesser relative density from said separation chamber after separation;

a motor and a drive coupled to and rotating said inlet pipe; and a baffle disposed within said separation chamber attached to said inlet pipe and said outlet pipe, oriented to direct the incoming fluent mixture to flow away from said vertical axis, thus subjecting the fluent mixture to centrifugal forces when said upper member and said stationary lower member are rotated by said drive and said motor, whereby said material of greater relative density is discharged by centrifugal action through said gap, and said material of lesser relative density is displaced by the material of greater relative density, and is constrained to be discharged through said outlet;

said centrifugal separator further comprising a spring retained against said frame and disposed to bear against said separable upper member about said vertical axis, said spring thus yieldingly opposing separation of said upper member from said stationary lower member when said upper member and said stationary lower member are rotated.

2. The centrifugal separator according to claim 1, further including a shroud disposed outside said gap, for intercepting and arresting material ejected therefrom when said centrifugal separator is operating.

3. A centrifugal separator for separating mixed materials having relatively greater and lesser densities from a fluent mixture thereof comprising:

a stationary frame;

a housing supported on said stationary frame, said housing further comprising:

a separable upper member rotatably movable about an axis and an axially stationary lower member defining an enclosed centrifugal separation chamber therebetween, there being a gap defined between said upper member and said stationary lower member when separated;

a pipe penetrating said separable upper member and attached to said stationary lower member, said pipe defining an inlet into said separation chamber, for admitting the fluent mixture thereinto for subsequent separation, said fluent mixture containing a material of lesser relative density and a material of greater relative density, said inlet constraining the fluent mixture to flow into said separation chamber in a predetermined direction parallel to said axis; said pipe further defining an outlet for discharging said material of lesser relative density from said separation chamber after separation;

said pipe oriented such that said axis is vertical, incoming mixed material thus entering said separation chamber by gravity, and the material of lesser relative density thus discharging from said outlet by gravity; and a baffle disposed within said chamber, oriented to direct the incoming fluent mixture to flow away from said axis, thus subjecting the fluent mixture to centrifugal forces when said upper member and said stationary lower member are rotated, whereby said material of greater relative density is discharged by centrifugal action through said gap, and said material of lesser relative density is displaced by the material of greater relative density, and is constrained to be discharged through said outlet;

a spring retained against said frame and disposed to bear against said separable upper member about said axis, said spring thus yieldingly opposing separation of said upper member from said stationary lower member when said upper member and said stationary lower member are rotated;

a motor and a drive coupled to and rotating said pipe responsive to operation of said motor, and a shroud disposed outside said gap for intercepting and arresting material ejected therefrom when said centrifugal separator is operating.

* * * * *